United States Patent [19]

Kullinger et al.

[11] 4,424,502

[45] Jan. 3, 1984

[54] TRANSFORMER WITH A CONTROLLED FLOW OF COOLING LIQUID

[75] Inventors: Kenneth Kullinger, Västeras; Mats Mattsson, Ludvika, both of Sweden

[73] Assignee: ASEA Aktiebolag, Västeras, Sweden

[21] Appl. No.: 438,119

[22] Filed: Nov. 1, 1982

[30] Foreign Application Priority Data

Dec. 17, 1981 [SE] Sweden ..... 8107579

[51] Int. Cl.[3] ..... H01F 27/10

[52] U.S. Cl. ..... 336/57; 165/104.31; 165/104.33; 174/14 R; 174/15 R; 336/55; 336/58; 336/60

[58] Field of Search ..... 336/55, 57, 58, 60; 165/104.31, 104.33; 174/14 R, 15 R

[56] References Cited

U.S. PATENT DOCUMENTS 3,602,856 6/1971 White ..... 336/57

3,867,982 2/1975 White ..... 165/104.31

FOREIGN PATENT DOCUMENTS 1963887 12/1969 Fed. Rep. of Germany .

*Primary Examiner*—A. T. Grimley

*Assistant Examiner*—Susan Steward

*Attorney, Agent, or Firm*—Pollock, Vande Sande & Priddy

[57] ABSTRACT

A transformer with a controlled flow of cooling liquid has a pressure chamber (10) which, via a hydraulic connecting member (14), is connected to a circulating pump which is included in a cooling circuit arranged outside a transformer tank (1). The connecting member (14) has a cavity (19), which is substantially formed as a rotational paraboloid, whereby an inlet tube (21), arranged at one end of said cavity and tangentially thereto, is connected to the circulating pump. One end of the member (14) is directly connected to the pressure chamber (10), whereas the other end of said member is connected to a cooling liquid collecting chamber (13) positioned outside the pressure chamber and defined by the transformer tank. (FIG. 1.)

4 Claims, 2 Drawing Figures

TRANSFORMER WITH A CONTROLLED FLOW OF COOLING LIQUID

TECHNICAL FIELD

The present invention relates to a transformer with a controlled flow of cooling liquid, comprising a transformer tank and an iron core arranged therein with yokes and legs and with windings arranged thereon, a pressure chamber arranged at a lower yoke, directing means, known per se, for directing a plurality of cooling liquid flows, emanating from the pressure chamber, to flow vertically along the winding in order thereafter to be collected in said transformer tank, said transformer tank being connected to at least one cooling circuit which comprises an outlet conduit connected to the transformer tank, a cooler arranged outside the transformer tank, a circulating pump, and at least one supply conduit connected between the output side of said circulating pump and said pressure chamber, said pressure chamber being hydraulically connected to a collecting space for cooling liquid, located within said transformer tank but outside the pressure chamber, via at least one hydraulic connecting member, the hydraulic resistance of said connecting member being smaller for a flow directed from the collecting space to the pressure chamber than for a flow in the opposite direction.

BACKGROUND ART

A transformer of the above kind is known from German Offenlegungsschrift No. 1963887.

The object of the invention is to construct and arrange said hydraulic connecting member in such a way that this member, besides having a sufficiently great hydraulic resistance during normal operation, in case of cut out of the circulating pump shall permit a stronger self-circulation of cooling liquid than what is possible when using corresponding, known hydraulic connecting means having no movable parts.

DISCLOSURE OF THE INVENTION

According to the invention, said hydraulic connecting member is substantially constituted by a hollow body which is internally defined by a surface of revolution and which has a first and a second end portion, said first end portion being connected to said pressure chamber, said second end portion comprising a first channel which is coaxially oriented in relation to the axis (A—A) of the surface of revolution and which connects the interior of said hollow body with said collecting space, said first channel being surrounded by a channel wall having a radially outwardly facing surface which defines radially inwards an annular portion of the space surrounded by said surface of revolution, said annular portion being connected at its outer periphery to at least one second channel which is passed through a substantially circular-cylindrical, radially outer wall portion defining said annular space portion, said at least one second channel being substantially tangentially directed in relation to said circular-cylindrical wall portion, the free end of said at least one second channel being connected to said at least one supply conduit.

The transformer core is constructed in the same way as that shown in the above-mentioned German publication and, substantially in the same way as that one, the core is arranged in a transformer tank and provided with an annular pressure chamber surrounding the legs, a cooling circuit including a cooler and a circulating pump being arranged outside the transformer tank and hydraulically connected thereto and to the pressure chamber.

BRIEF DESCRIPTION OF DRAWINGS

In the following the invention will be described with reference to the accompanying drawing, in which FIG. 1 shows a partial vertical section of a transformer according to the invention along I—I of FIG. 2, whereas

DESCRIPTION OF PREFERRED EMBODIMENTS

Figure 1:
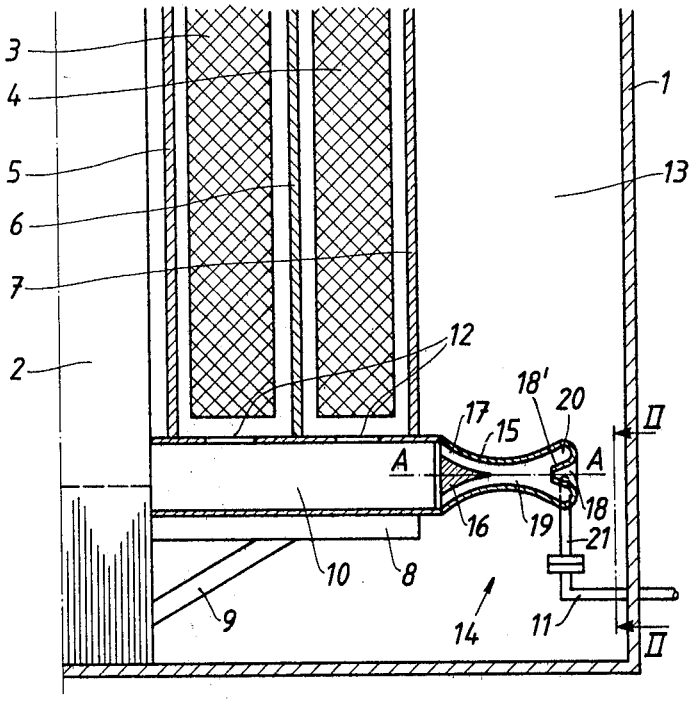
Figure 2:
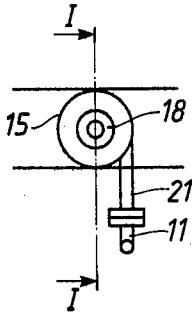
FIG. 2 shows the above-mentioned hydraulic connecting member in a partial view perpendicular to a vertical plane II—II.

In FIG. 1, 1 designates the transformer tank, 2 one of the core legs and 10 the pressure chamber. Each core leg 2 is surrounded by two windings 3 and 4, and insulating cylinders 5, 6, 7 are arranged in a known manner around the windings for insulation and for control of a flow of cooling liquid flowing through and/or along said windings. Supports for the windings in the form of a plate 8 with a bracket 9 are arranged in a well-known manner at the lower end surfaces of the windings. A hollow annular body defining the pressure chamber 10 extends around the whole core, covers the lower end surfaces of the windings and is arranged between the plate 8 and the lower end surfaces of the windings. Cooled oil is pressed from the above-mentioned cooling circuit (not shown) through at least one supply conduit 11 to the pressure chamber 10. On the side facing the end surfaces of the windings, the pressure chamber is provided with at least one, preferably a plurality of outlets 12, preferably vertically below corresponding windings. A large number of such outlets are provided in order to obtain an even distribution of coolant. Outlets, windings and insulating cylinders are arranged in such a way that the cooling liquid flowing out of the outlets 12 enters the windings and—at the upper end surfaces of the windings—flows out into a collecting space 13 constituted by that part of the inner volume of the transformer tank 1 which is not occupied by the transformer core, the windings, the pressure chamber, etc. Above the transformer core, the space 13 has an outlet opening (not shown) for cooling liquid, said outlet opening being connected to an inlet opening of the above-mentioned cooling circuit.

If the supply of cooling liquid to the pressure chamber via the supply conduit or conduits 11 is interrupted, it is important that the forced coolant circulation is immediately replaced by self-circulation and that this is so efficient that no impermissible increase in temperature takes place before the transformer is disconnected. In order that self-circulation may take place, the pressure chamber 10 is arranged in hydraulic connection with the collecting space 13. To be able to obtain such a connection independently of valves with movable parts, and according to a principle known per se, at least one hydraulic connecting member is used, having a great hydraulic resistance in the direction pressure chamber—collecting space and a relatively small resistance in the opposite direction. However, in the transformer shown in FIG. 1, this connecting member, 14, is designed and arranged in a special manner so that the member, to a larger extent than corresponding known members, fulfils the requirements for great hydraulic resistance between pressure chamber and collecting space during normal operation in combination with small hydraulic resistance between collecting space 13 and pressure chamber 10 in the event that the pump becomes inoperative.

The connecting member 14 substantially consists of a hollow body 15 which surrounds a space 19 defined by a surface of revolution. The geometrical axis of the surface of revolution is designated A—A. The space surrounded by the surface of revolution is substantially shaped as a paraboloid of revolution with a relatively narrow mid-portion. The diameter of said mid-portion is smaller than 80%, preferably smaller than 60%, of the inner diameter of the hollow body 15 at any end portion.

At one end, the hollow body is mechanically and hydraulically connected to the pressure chamber 10 and provided with a coaxially arranged, preferably solid body 16, tapering in a direction towards the other end, a channel, 17, having annular cross-section being defined by the bodies 15 and 16. The body 16 is fixed to the body 15 by means of a plurality of thin rods, not shown on the drawing. Alternatively, instead of rods, a plurality of thin guide vanes can be used, the channel 17 then being divided into a plurality of partial channels. Nearest the pressure chamber 10, each guide vane is then formed with an end portion lying in an axial plane, whereas surface portions lying at a larger distance from the pressure chamber 10 make an angle with the axis A—A, this angle increasing with the distance from the pressure chamber 10. The body 16 is preferably pointed at one end and substantially made in the form of a solid of revolution. At its free end the connecting member 14 has an integrated portion, substantially formed as a hollow, truncated cone, 18', which by its inner conical surface defines a coaxial channel 18 through which the space 19 surrounded by the hollow body is in communication with the collecting space 13. The external surface of the cone 18' defines, radially inwardly, an annular portion, 20, of the space 19. At its outer periphery the annular portion 20 is connected to a tube 21 which is passed through a substantially circular-cylindrical portion of an outer wall, defining the annular portion 20 radially outwardly. At least at the inlet end, the tube 21 is substantially tangentially directed in relation to the circular-cylindrical wall portion. The free end of the tube is flanged to the supply conduit 11.

During normal transformer operation, cooling liquid flows into the annular space portion 20 and is put into rotation about the axis A—A. During the further movement towards the mid-portion of the hollow body 15, the axial and tangential speed of the cooling liquid increase, which causes the pressure to fall. The pressure is regained when the oil flows through the channel 17, since the diameter and cross-section of said channel increase in a direction towards the pressure chamber 10. The low pressure in the mid-portion of the hollow body 15, in combination with the effect of forces of inertia, result in only a small amount of liquid flowing through the channel 18 and out into the collecting space 13.

If the liquid flow flowing through the tube 21 disappears, for example in case of cut-out of the circulating pump connected to the supply conduit 11, cooling liquid will flow from the collecting space 13 and into the pressure chamber via the channel 18. Since the hydraulic member 14 during normal transformer operation is capable of conducting practically all of the liquid flow, supplied via the conduit 11, to the pressure chamber, the member 14 can be given such large dimensions that in case of self-circulation it only constitutes a very small part of the hydraulic resistance of the circulating circuit. Alternatively, a relatively large number of hydraulic connecting members, constructed according to the invention, can be connected to the pressure chamber, said connecting members being connected to one supply conduit each. Then the supply conduits can be connected to a common circulating pump, or each supply conduit may belong to one corresponding cooling circuit.

Instead of the hydraulic member 14 shown on the drawing, a similar member can be used according to the invention, which differs from that shown by having a plurality of supply channels which are directed and connected in the same way as the tube 21.

Further, in a transformer according to the invention a fully satisfying effect of the member 14 can be achieved in many cases also if the body 16 is missing.

We claim:

1. Transformer with a controlled flow of cooling liquid, comprising a transformer tank (1) and an iron core arranged therein with yokes and legs (2) and with windings arranged thereon, a pressure chamber (10) arranged at a lower yoke, directing means for directing a plurality of cooling liquid flows, emanating from the pressure chamber, to flow vertically along the windings in order thereafter to be collected in said transformer tank, said transformer tank being connected to at least one cooling circuit which comprises an outlet conduit connected to the transformer tank, a cooler arranged outside the transformer tank, a circulating pump, and at least one supply conduit (11) connected between the output side of said circulating pump and said pressure chamber, said pressure chamber (10) being hydraulically connected to a collecting space (13) for cooling liquid, located within said transformer tank but outside the pressure chamber, via at least one hydraulic connecting member, the hydraulic resistance of said connecting member being smaller for a flow directed from the collecting space to the pressure chamber than for a flow in the opposite direction, characterised in that said hydraulic connecting member (14) is substantially constituted by a hollow body (15) which is internally defined by a surface of revolution and which has a first and a second end portion, said first end portion being connected to said pressure chamber, said second end portion comprising a first channel (18) which is coaxially oriented in relation to the axis (A—A) of the surface of revolution and which connects the interior of said hollow body with said collecting space (13), said first channel (18) being surrounded by a channel wall having a radially outwardly facing surface, which defines radially inwards an annular portion (20) of the space (19) surrounded by said surface of revolution, said annular portion (20) being connected at its outer periphery to at least one second channel (21) which is passed through a substantially circular-cylindrical, radially outer wall portion defining said annular space portion (20), said at least one second channel (21) being substantially tangentially directed in relation to said circular-cylindrical wall portion, the free end of said at least one second channel (21) being connected to said at least one supply conduit (11).

2. Transformer according to claim 1, characterised in that said hollow body (15) has a mid-portion, the smallest inner diameter of which is smaller than 80% of the maximum inner diameter of any of the two end portions.

3. Transformer according to claim 1, characterised in that said first end portion surrounds a body (16) which is coaxially arranged in relation to said first end portion and which is tapering in a direction towards said second end portion, a gap (17) with substantially annular cross-section being defined between said first end portion and said tapering body.

4. Transformer according to claim 1, characterized in that said surface of revolution for the major part is constituted by a paraboloid of revolution having a relatively thin mid-portion.

* * * * *